US006648703B2

(12) United States Patent
McChesney et al.

(10) Patent No.: US 6,648,703 B2
(45) Date of Patent: Nov. 18, 2003

(54) CONVERTIBLE OUTBOARD MOTOR TILLER ARM AND MOTOR INCORPORATING SAME

(75) Inventors: Ric McChesney, Waukegan, IL (US); Paul Dayenian, Beach Park, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 10/171,460

(22) Filed: Jun. 12, 2002

(65) Prior Publication Data

US 2003/0013357 A1 Jan. 16, 2003

Related U.S. Application Data

(60) Provisional application No. 60/331,336, filed on Jun. 12, 2001.

(51) Int. Cl.[7] ..... B63H 5/125
(52) U.S. Cl. ..... 440/63
(58) Field of Search ..... 440/53, 63; 114/146

(56) References Cited

U.S. PATENT DOCUMENTS 5,046,974 A * 9/1991 Griffin, Jr. et al. ..... 440/63
5,591,055 A * 1/1997 Ambrico et al. ..... 440/6
5,669,322 A * 9/1997 Huzjak ..... 114/146
6,093,066 A * 7/2000 Isogawa et al. ..... 440/63

* cited by examiner

*Primary Examiner*—Stephen Avila
(74) *Attorney, Agent, or Firm*—Ziolkowski Patent Solutions Group, LLC

(57) ABSTRACT

A convertible or collapsible tiller arm assembly is provided for an outboard motor. The motor may be of a generally conventional structure, but includes an interface bracket for mounting the tiller arm assembly in place. The tiller arm assembly has a mating bracket which is fixed to the outboard motor for securement of the tiller arm assembly in a deployed position. Threaded fasteners may be employed for rapidly moving the assembly to the deployed position, and for collapse of the assembly. Anti-rotation structures afford transmission of steering torques to the outboard motor when the tiller arm is in the deployed position. In the collapsed position, the overall assembly offers a significantly reduced envelope dimension, facilitating storage and passing of the outboard motor through hatches, openings, and the like.

31 Claims, 4 Drawing Sheets

CONVERTIBLE OUTBOARD MOTOR TILLER ARM AND MOTOR INCORPORATING SAME

This application claims priority to Provisional Application Serial No. 60/331,336, which benefits from a filing date of Jun. 12, 2001.

BACKGROUND OF THE INVENTION

The present invention relates generally to outboard motors for marine craft. The invention relates, more particularly, to a technique for reducing the envelope dimensions of an outboard motor by providing a collapsible or removable tiller arm structure.

A wide variety of designs have been developed for marine outboard motors. In general, such motors include a primary source of power, an internal combustion engine, coupled to one or more drive props. The motor assembly is designed and packaged to be secured to a watercraft, typically to a transom reinforced to receive the motor. The engine rests above the waterline, while the prop, which is drivingly coupled to the engine via a shaft or similar mechanical transmission linkages, is positioned below the waterline during use. The motor mount provides for both tilt and trim, as well as pivotal movement for positioning the motor so as to produce a resultant force vector needed for steering the watercraft in a desired direction.

The steering of outboard motors may be managed in various ways. For example, remote, and even power-assisted steering systems are available which can be coupled to the motor mounts to provide for steering from a helm either within a cabin and on deck. The motors may also be steered manually via a tiller arm which extends from a front region of the motor and which is grasped by the operator to position the motor in the desired orientation. In many designs, the tiller arm also is equipped with throttle controls, allowing the operator not only to position the motor, but to control the speed of rotation and thereby the velocity of the craft.

Once the tiller arm is secured to an outboard motor, it typically protrudes from the outboard motor substantial distance, allowing for the moment or leverage sufficient for the operator to rotate the motor during use. However, the overall envelope dimension of the motor is substantially increased by the extension of the tiller arm. In certain applications such extension becomes quite problematic. For example, wherein the motor is stored in or removed from relatively close quarters, the extended tiller arm may encumber the motor, or even render its passage through openings difficult or impossible. In certain applications, for example, outboard motors must be available for passage through hatches or similar access routes, requiring envelope dimensions which cannot be obtained through the use of conventional tiller arm securement arrangements.

There is a need, therefore, for an improved outboard motor structure in which a manually steerable tiller arm can be rigidly secured to the motor, but displaced to provide a significantly smaller envelope dimension when needed. There is a particular need for a novel tiller arm arrangement which does not require numerous parts or tools for securement of the tiller arm in an extended position, or for collapsing the tiller arm to a retracted or removed position, and which does not allow various securement parts to be separated from the motor package. Similarly, there is a significant need for a collapsible or removable tiller arm arrangement in an outboard motor that provides for very rapid and straightforward deployment of a removable or collapsible tiller arm and, conversely, for collapsing or removing such tiller arm through a series of simple steps that can be performed in a time-efficient manner.

SUMMARY OF THE INVENTION

The present invention provides a technique for securing a tiller arm assembly to an outboard motor, and for displacing the tiller arm assembly with respect to the motor package designed to respond to such needs. The technique may be employed on a wide range of motor designs, as well as on a range of motor sizes and ratings. In general, the technique provides for a mounting structure which is secured to the outboard motor and receives a tiller arm assembly. The tiller arm assembly is movable or removable with respect to the mounting structure, and is collapsible upon manipulation of a securement piece. The securement piece may be manipulated in an inverse sense for deployment of the tiller arm. Other securement elements may serve to maintain the tiller in the displaced or deployed positions. The securement elements are conveniently attached to the motor package, such as via lanyards.

In one embodiment of the technique, a tiller arm mount is provided on an outboard motor, and a tiller arm assembly bracket is provided from which the tiller arm extends. A securement member or bracket extends from the motor package, and may include a threaded fastener. A mating element interfaces with the securement member to fix the tiller arm assembly in the deployed position. The tiller arm assembly may be pivotable with respect to the support housing. Moreover, the securement member extending from the motor package may extend through the assembly bracket, such that a simple placement of the bracket on the motor package and securement of the interfacing member suffices to place the tiller arm assembly in the deployed position. Thus, for deployment, the tiller arm assembly only needs to be mounted on the interface bracket member, and the securement member fixed in place for attachment in the deployed position.

Other features may include a shift rod, and securement members for the shift rod, where provided. The mounting structure provided on the motor package preferably interfaces with the tiller arm assembly bracket to provide an extremely solid attachment to the motor package, while allowing transmission of moments for steering the motor during use. Lanyards may be provided for all of the attachment elements, as well as for the tiller arm, to secure the various components in place and to prevent them from being separated from the motor package. In addition, where throttle and other controls are provided on the tiller arm, these may be routed through a harness extending on or through the tiller arm, and the tiller arm may be secured to the motor package via the harness.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
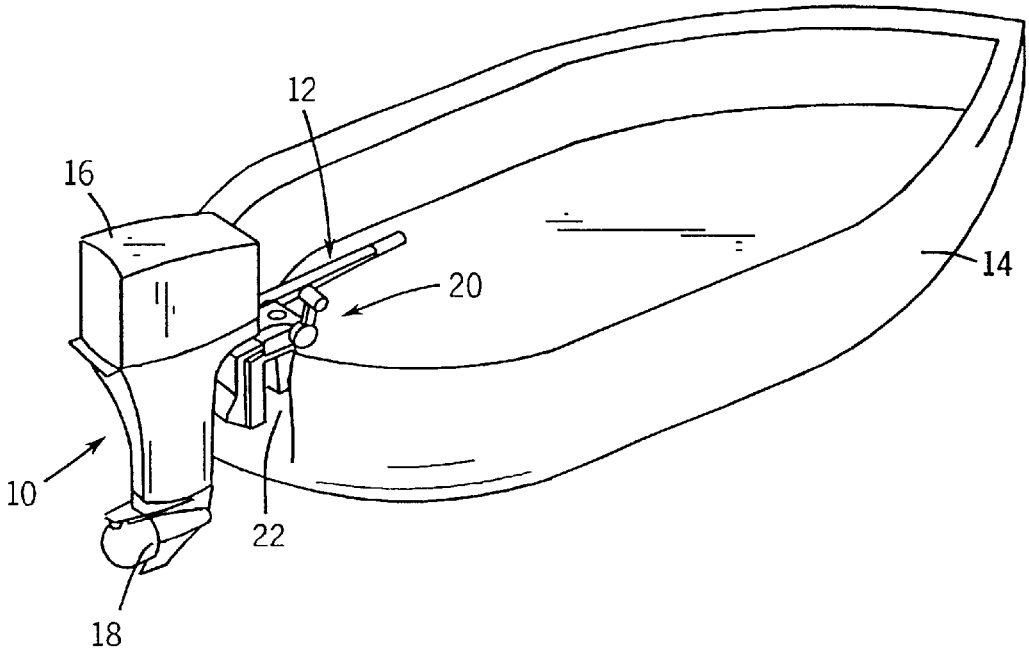
FIG. 1 is a perspective view of watercraft equipped with an outboard motor having a collapsible or convertible tiller arm assembly in accordance with aspects of the present technique.

Turning now to the drawings, and referring first to FIG. 1, an outboard motor 10 is illustrated as incorporating a collapsible or convertible tiller arm assembly 12 in accordance with aspects of the present technique. The motor may be of a generally conventional design, and may be temporarily or permanently installed on a watercraft, such as a boat 14. In the illustrated embodiment, the motor 10 includes a head 16 in which an internal combustion engine is supported, and a prop assembly 18 which is driven in rotation by the motor to propel the boat in desired directions. A mounting assembly 20, which may include a tilt and trim assembly, transom bracket and so forth, is included and secured to the motor for mounting the motor on the transom 22 of boat 14.

Figure 2:
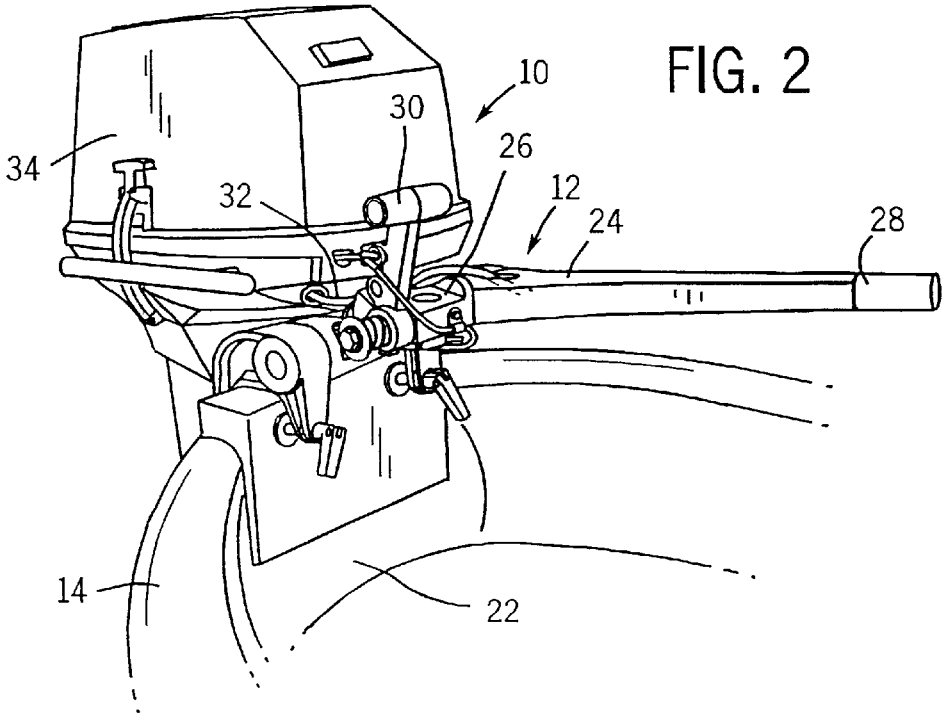
FIG. 2 is a perspective view in somewhat greater detail of the motor and tiller arm assembly of FIG. 1 illustrating the tiller arm assembly in a deployed position.

The tiller arm assembly 12 is designed to be selectively placed in a deployed position as illustrated in FIGS. 1 and 2, or in a collapsed position as described below. FIG. 2 illustrates the front view of a present embodiment of the tiller arm assembly 12. As shown in FIG. 2, the tiller arm assembly includes a tiller arm 24 extending from the outboard motor from a securement bracket 26. The tiller arm 24, in the illustrated embodiment, is fixedly secured to the securement bracket 26. The securement bracket 26 is, in turn, mounted on a mating bracket of the outboard motor, described in greater detail below.

The tiller arm 24 permits rotation of the outboard motor in a conventional manner for steering. In the illustrated embodiment, the tiller arm assembly 12 also includes controls for both shifting the outboard motor, and for varying the rotational speed of the prop. In particular, a throttle control 28 is provided at a distal end of the tiller arm 24 for varying the boat speed. A shift lever 30 is mounted on the securement bracket 26 and supported thereon for shifting the motor in the illustrated embodiment. A shift rod 32 extends from a housing 34 of the motor, and interfaces with the shift lever 30 as described in greater detail below.

Figure 3:
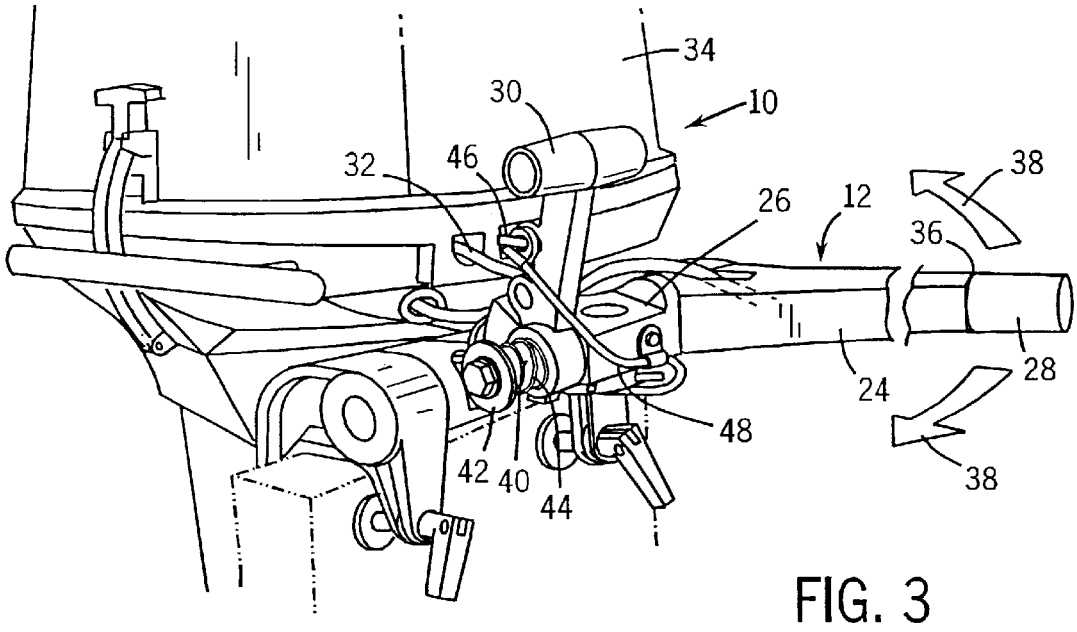
FIG. 3 is a view similar to that of FIG. 2, in greater detail, illustrating a preferred manner for securing the tiller arm assembly in the deployed position.

FIG. 3 illustrates the collapsible tiller arm assembly 12 of FIG. 2 in greater detail. As noted above, the tiller arm assembly 12 includes a tiller arm 24 and a throttle control 28 in the illustrated embodiment. The tiller arm 24 extends from a securement bracket 26 which is removably or collapsibly secured to the outboard motor 10. The tiller arm thus forms a handle 36 which can be gripped by an operator and forced in either horizontal direction to apply a steering torque to the motor, as indicated by arrows 38 in FIG. 3. As will be appreciated by those skilled in the art, the length of the tiller arm may be selected so as to provide sufficient moment for steering the motor, and for opposing forces resisting such steering.

FIG. 3 also illustrates in somewhat greater detail the present arrangement for mounting shift lever 30 and for interfacing the shift lever with shift rod 32. In the illustrated embodiment, a shaft 40 extends from securement bracket 26. Shift lever 30 is slidably mounted on the shaft 40. An abutment 42 terminates the shaft, and a spring 44 is provided between the abutment 42 and shift lever 30 for urging the shift lever toward the right in the view of FIG. 3. A pin 46 serves to join the shift lever 30 and the shift rod 32 extending from the outboard motor housing 34. As described in greater detail below, the pin may be removed for uncoupling the shift lever 30 from the shift rod 32, thereby allowing removal or collapsing of the entire tiller arm assembly. To facilitate mounting of the various components of the assembly, and to prevent loss of the pin 46 and other components, lanyards 48 may be provided and the various components secured to the securement bracket 26 via the lanyards.

Figure 4:
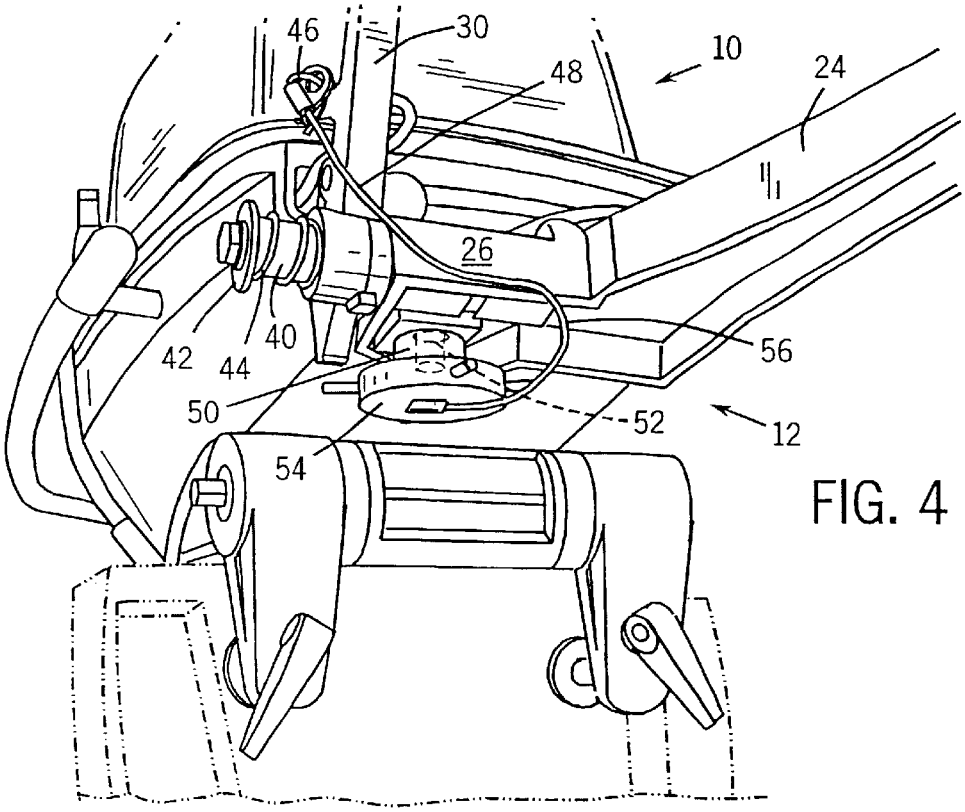
FIG. 4 is a bottom perspective view of the assembly of FIG. 3, illustrating the manner in which the tiller arm assembly is supported and maintained in place on the outboard motor.

FIG. 4 illustrates the foregoing structure in a bottom prospective view to better show a presently preferred manner for mounting the securement bracket to the outboard motor. In the view of FIG. 4, the securement bracket 26 is illustrated in bottom prospective so as to reveal a male threaded fastener 50 which extends from the outboard motor to hold the tiller arm assembly bracket 26 in place. Fastener 50 extends through an aperture 52 formed in the bracket 26. A mating fastener 54 is secured to fastener 50 to draw the bracket 26 into tight engagement on the outboard motor, and to prevent its removal during use. As with pin 46 illustrated in FIG. 3, a lanyard 56 is provided for maintaining the threaded fastener 54 in the assembly and to prevent its removal or loss.

Figure 5:
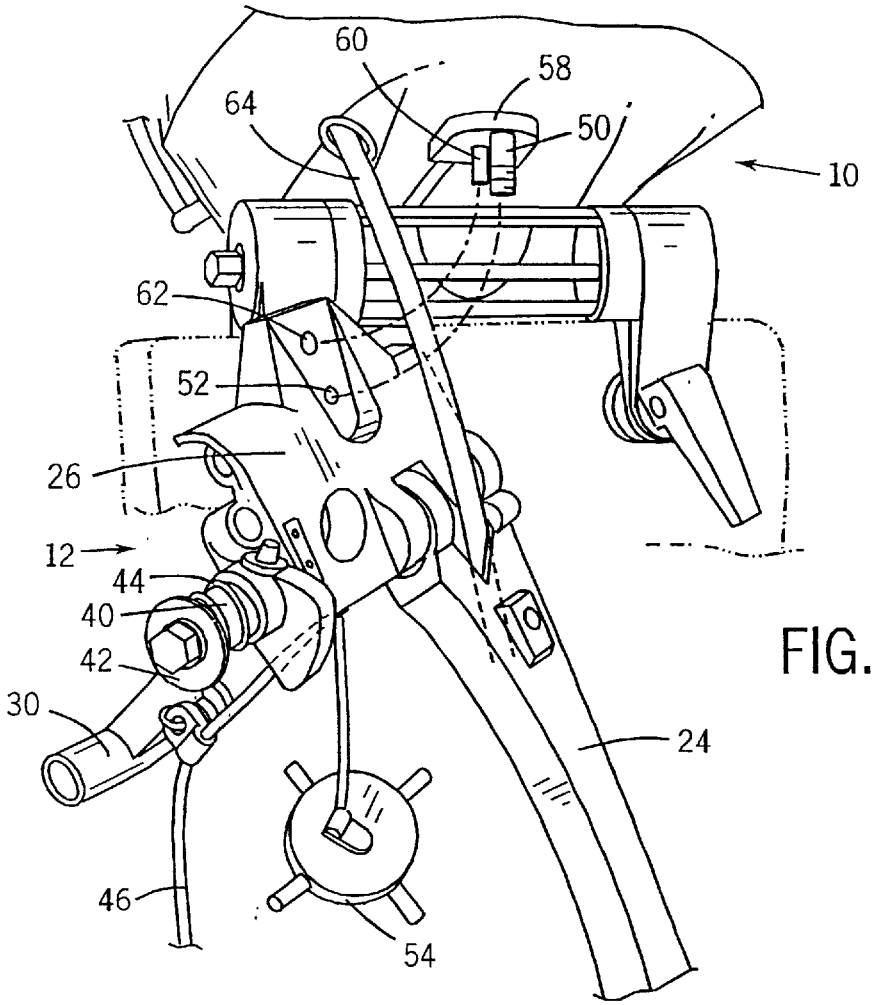
FIG. 5 is a perspective view similar to that of FIG. 4, illustrating the tiller arm assembly in a collapsed or removed position.

Referring to FIG. 5, a bracket 58 is illustrated as extending from the outboard motor for securement of the tiller arm assembly in the deployed position. As illustrated in FIG. 5, the bracket 58 includes the threaded fastener 50 discussed above, as well as an anti-rotation pin 60. The fastener and anti-rotation pin interface with bracket 26 of the tiller arm assembly, illustrated in the removed or collapsed position in FIG. 5. Specifically, aperture 52 is provided for receiving fastener 50 therethrough, while a second aperture 62 is provided for receiving anti-rotation pin 60. The tiller arm assembly is mounted in the deployed position by locating the fastener 50 and anti-rotation pin 60 in relation to the apertures 52 and 62, respectively, and by securing the threaded fastener 54 (see FIG. 4) in place on fastener 50. The two brackets thus interface with one another to mount the tiller arm assembly securely in place. As also illustrated in FIG. 5, the entire tiller arm assembly 12 may be secured to the motor by a lanyard or by a cable assembly 64 used to convey throttle commands from the tiller arm assembly to the outboard motor.

Figure 6:
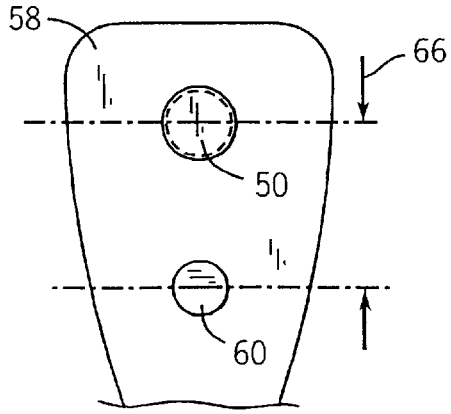
FIG. 6 is a detailed representation of a portion of a bracket for securing the tiller arm assembly in place and for resisting moments as the outboard motor is steered.

The fastener 50 and anti-rotation pin 60 are spaced from one another sufficiently to convey moments applied to the tiller arm assembly to the outboard motor for steering the boat in desired directions. As illustrated in the detailed view of FIG. 6, a distance 66 between these elements serves to resist the couple applied to them upon steering of the tiller arm assembly. Alternative structures may, of course, be envisaged, including more than two pins or fasteners, interfacing brackets or abutment surfaces, insertion tubes, sleeves and cooperating shafts, and so forth.

As noted above, the shift lever 30 is secured to the tiller arm assembly bracket 26 in the illustrated embodiment. The presently preferred arrangement permits removal of the shift lever 30 from the shift rod 32 (see, e.g., FIG. 3) by spring-loading the shift lever 30 in an engaged position. Thus as illustrated in FIG. 4, the shift lever 30 is urged by spring 44 toward the bracket 26. In this position, the shift lever 30 interfaces with the shift rod 32 extending from the motor housing. For removal of the shift lever from the shift rod, and removal of the tiller arm assembly from the deployed position, the pin 46 retaining the shift lever and shift rod in a coupled configuration is removed, and the shift lever is slid along shaft 40 against the force of spring 44 (i.e., to the left in the view of FIG. 4). Once the shift lever and shift rod are disengaged from one another, the fastener 54 securing the bracket 26 in place may be removed, and the entire tiller arm assembly removed or collapsed.

Figure 7:
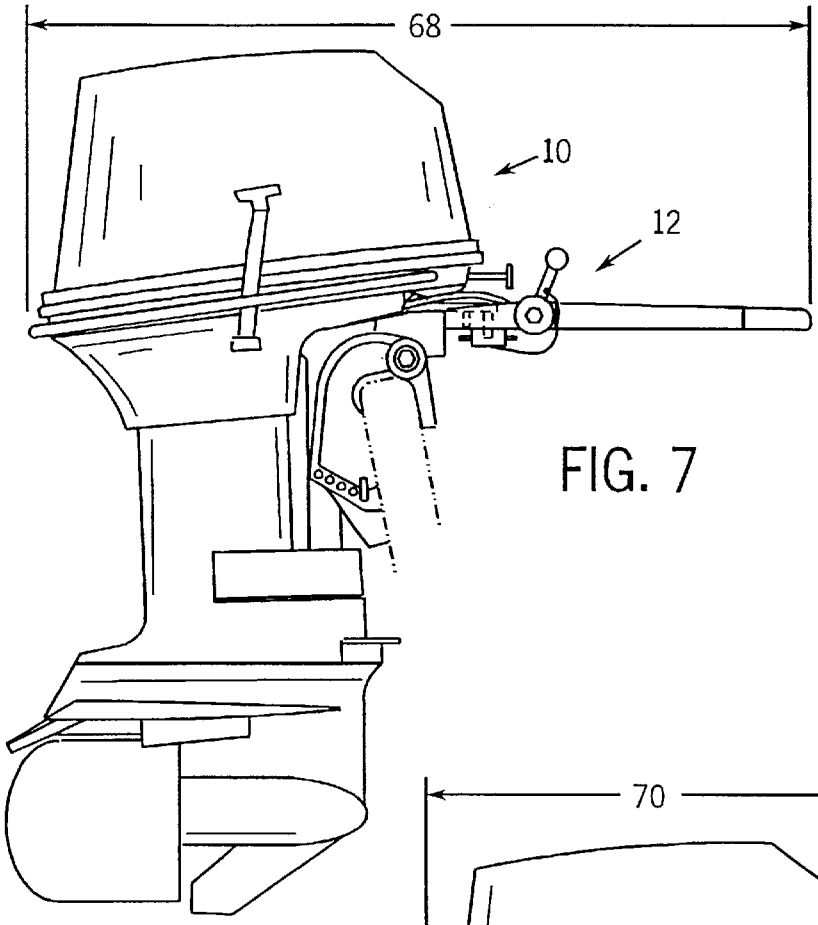
FIGS. 7 and 8 are side elevational views of an exemplary outboard motor equipped with a collapsible or convertible tiller arm assembly, and illustrating the extended and collapsed dimensions of the entire system with the tiller arm assembly in the deployed and collapsed positions, respectively.
Figure 8:
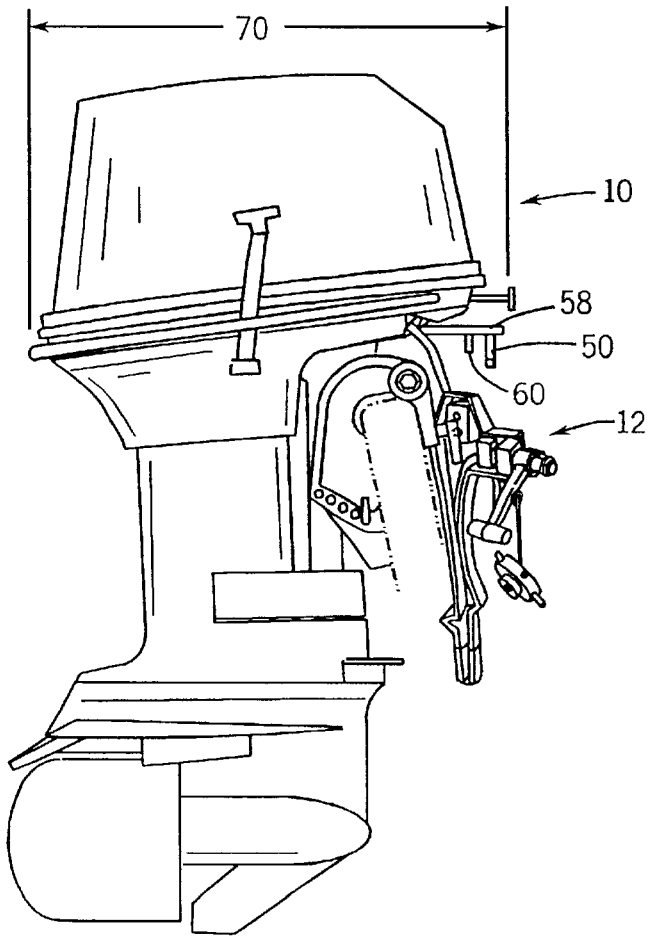

The collapsible characteristics of the present tiller arm assembly greatly facilitate stowing and displacement of the outboard motor. It has been found that in a number of applications, such as aboard larger boat, submarines, naval craft, and so forth, outboard motors must be stowed and moved through relatively tight quarters or through hatches or similar openings. As illustrated in FIGS. 7 and 8, the collapsible design of the tiller arm assembly therefore permits significantly reduced envelope dimensions as compared to conventional structures. FIG. 7, by way of example, illustrates an extended envelope dimension 68 of the motor where the tiller arm assembly 12 is secured in the deployed position. When the tiller arm assembly is collapsed, as shown in FIG. 8, a significantly reduced overall envelope dimension 70 is offered.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A collapsible tiller arm system for an outboard motor, the system comprising:

a support securable to an outboard motor package, the support including a first interface bracket;

a first securement member scoured to the support;

a tiller arm including a second interface bracket configured to mate with the first interface bracket and the first securement member;

a second securement member configured to be fitted to the first securement member to maintain the tiller arm in a deployed position arid to be removed from the first securement member to allow movement of the tiller arm to a stowed position; and wherein the first interface bracket includes and anti-rotation pin and the second interface bracket includes a recess configured to receive the anti-rotation pin to permit transmission of moments on the tiller arm to the outboard motor for steering the outboard motor.

2. The system of claim 1, wherein the first securement member is secured to the first interface bracket.

3. The system of claim 1, wherein the first securement member includes a first threaded fastener.

4. The system of claim 3, wherein the second interface bracket includes an aperture configured to receive thc threaded fastener therethrough.

5. The system of claim 4, wherein the second securement member includes a second threaded fastener configured to threadingly engage the first threaded fastener.

6. The system of claim 5, wherein the first threaded fastener is a bolt and the second threaded fastener is a nut.

7. The system of claim 1, wherein the second securement member is retained on the motor package via a lanyard.

8. The system of claim 1, wherein the tiller arm is secured to the motor package in the collapsed position by a harness.

9. The system of claim 1, further comprising a shift member mounted to the support and movable on the support.

10. A collapsible tiller arm system for an outboard motor, the system comprising:

a support securable to an outboard motor package, the support including a first interface bracket;

a first securement member secured to the support;

a tiller arm including a second interface bracket configured to mate with the first interface bracket and the first securement member; and a second securement member retained on die motor package via a lanyard and configured to be fitted to the first securement member to maintain the tiller arm in a deployed position and to be removed from the first seenrement member to allow movement of the tiller arm to a stowed position.

11. An outboard motor and convertible tiller arm system, the system comprising:

an outboard motor including a first interface bracket having a first securement member and an anti-rotation abutment having an anti-rotation pin;

a convertible tiller arm having a second interface bracket configured to mate with the first interface bracket for supporting the tiller arm in deployed position and displaceable with respect to the first interface bracket to permit movement of the tiller arm to a stowed position, the anti-rotation abutment cooperating with the second interface bracket to transmit moments from the tiller arm to the outboard motor when the tiller arm is in the deployed position; and a second securement member configured to interface with the first interface member to maintain the tiller arm in the deployed position.

12. The system of claim 11, wherein the second interface bracket is detachable from the first interface bracket for displacement of the tiller arm to the stowed position.

13. The system of claim 11, wherein the first securement member includes an externally threaded fastener extending from the first interface bracket.

14. The system of claim 13, wherein the second securement member includes an internally threaded fastener configured to mate with the externally threaded fastener.

15. The system of claim 14, wherein the second securement member is separable from to second securement bracket.

16. The system of claim 11, wherein the second interface bracket includes a recess configured to receive the anti-rotation pin.

17. The system of claim 11, wherein the tiller arm includes a throttle control and a harness for communicating throttle commands from the throttle control to the outboard motor.

18. A collapsible tiller arm system for an outboard motor, the system comprising:

a support securable to an outboard motor package, the support including a first interface bracket;

a first securement member secured to the support;

a tiller arm including a second interface bracket configured to mate with the first interface bracket and die first securement member a second securement member configured to be fitted to thc first securement member to maintain the tiller arm in a deployed position and to be removed from the first securement member to allow movement of the tiller arm to a stowed position; and wherein the tiller anti is secured to the motor package in the collapsed position by a harness.

19. An outboard motor and convertible tiller arm system, the system comprising:

an outboard motor;

a tiller arm interface bracket secured to the outboard motor, the interface bracket being configured to receive and support a tiller arm assembly and to prevent rotation of the tiller arm assembly with respect to the outboard motor for steering of the outboard motor; and wherein the tiller arm assembly is securable to the interface bracket in a deployed position and removable from the interface bracket for movement to a stowed position wherein the tiller arm assembly is tethered to the outboard motor.

20. The system of claim 19, wherein the interface bracket includes a first fastener for securement of the tiller arm assembly thereto.

21. The system of claim 20, wherein the tiller arm assembly includes a second fastener configured to mate with the first fastener for securement of the tiller arm assembly in the deployed position.

22. The system of claim 20, further comprising a second fastener is retained on the outboard motor via a lanyard.

23. The system of claim 19, wherein the interface bracket includes an anti-rotation pin for preventing rotation of the tiller arm assembly with respect to the outboard motor, and wherein the tiller arm assembly includes a mounting member having a recess for receiving the anti-rotation pin.

24. The system of claim 19, wherein the tiller arm assembly includes a throttle control and a harness for communicating throttle commands from the throttle control to the outboard motor.

25. An outboard motor and convertible tiller arm system, the system comprising:

an outboard motor;

a tiller arm interface bracket secured to the outboard motor, the interface bracket having a first fastener for securement of the tiller arm assembly and being configured to receive and support a tiller arm assembly and to prevent rotation of the tiller arm assembly with respect to the outboard motor for steering of the outboard motor;

the tiller arm assembly securable to the interface bracket in a deployed position and removable from the interface bracket for movement to a stowed position; and a second fastener retained on the outboard via a lanyard.

26. An outboard motor and convertible tiller arm system, the system comprising:

an outboard motor;

a tiller arm interface bracket secured to the outboard motor, the interface bracket being configured to receive and support a tiller arm assembly and to prevent rotation of the tiller arm assembly with respect to the outboard motor the steering of the outboard motor;

the tiller arm assembly having a mourning member and securable to the interface bracket in a deployed position and removable from the interface bracket for movement to a stowed position; and an anti-rotation pin which extends from the interface bracket for preventing rotation of the tiller arm assembly with respect to the outboard motor, and wherein the mounting member has a recess for receiving the anti-rotation pin.

27. A collapsible tiller arm assembly comprising:

a first bracket securable to an outboard motor and having at least two studs extending therefrom;

a second bracket having a recess having at least two holes therethrough;

a tiller arm pivotably attached to the second bracket; and wherein the recess of the second bracket is constructed to snuggly engage the first bracket and prevent rotation therebetween.

28. The assembly of claim 27 further comprising a tether having one end connected to the second bracket and having another end connectable to an outboard motor.

29. The assembly of claim 27 further comprising a fastener constructed to engage at least one of the at least two studs and having a tether connectable to an outboard motor.

30. The assembly of claim 27 further comprising a throttle control attachable to the second bracket and a throttle cable of an outboard motor.

31. The assembly of claim 27 wherein at least one of the at least two studs extends completely through the second bracket.

* * * * *

UNITED STATES PATENT AND TRADEMARK OFFICE

CERTIFICATE OF CORRECTION

PATENT NO. : 6,648,703 B2
DATED : November 18, 2003
INVENTOR(S) : McChesney et al.

It is certified that error appears in the above-identified patent and that said Letters Patent is hereby corrected as shown below:

Column 5,
Line 50, delete the word “arid” and substitute therefore -- and --;
Line 53, delete the word “and” and substitute therefore -- an --;

Column 6,
Lines 17 and 66, delete the word “die” and substitute therefore -- the --;
Line 21, delete “seenrement” and substitute therefore -- securement --;

Column 7,
Line 6, delete “anti” and substitute therefore -- arm --;
Line 28, delete the word “is”.

Signed and Sealed this

Sixth Day of April, 2004

JON W. DUDAS
*Acting Director of the United States Patent and Trademark Office*